United States Patent [19]

Noschese

[11] Patent Number: 4,842,538

[45] Date of Patent: Jun. 27, 1989

[54] LOW INSERTION FORCE CIRCUIT BOARD CONNECTOR ASSEMBLY

[75] Inventor: Rocco J. Noschese, Wilton, Conn.

[73] Assignee: Burndy Corporation, Norwalk, Conn.

[21] Appl. No.: 284,109

[22] Filed: Dec. 14, 1988

Related U.S. Application Data

[63] Continuation of Ser. No. 554,745, Nov. 23, 1983, abandoned.

[51] Int. Cl.[4] ..... H01R 13/62

[52] U.S. Cl. ..... 439/260; 439/329

[58] Field of Search ..... 439/259-261, 439/263, 265-270, 329, 629-637

[56] References Cited

U.S. PATENT DOCUMENTS

| | | | |
|---|---|---|---|
| 3,130,351 | 4/1964 | Giel . | |
| 3,399,372 | 8/1968 | Uberbacher | 339/176 MP |
| 3,504,330 | 3/1970 | Holzhaeuser | 339/75 MP |
| 3,518,610 | 6/1970 | Goodman et al. | 339/176 MP |
| 3,526,869 | 9/1970 | Conrad et al. | 339/176 MP |
| 4,159,861 | 7/1979 | Anhalt | 339/75 MP |
| 4,165,909 | 8/1979 | Yeager et al. | 339/75 MP |
| 4,303,294 | 12/1981 | Hamsher, Jr. et al. | 339/74 R |
| 4,343,523 | 8/1982 | Cairns et al. | 339/176 MP |
| 4,403,819 | 9/1983 | Weber | 339/176 MP |
| 4,487,468 | 12/1984 | Fedder et al. | 339/75 MP |

FOREIGN PATENT DOCUMENTS

| | | | |
|---|---|---|---|
| 41253/68 | 7/1968 | Australia . | |
| 1048062 | 11/1966 | United Kingdom | 339/176 MP |

OTHER PUBLICATIONS

Reynolds, M. J., "Designing A Connector for Backplanes of the Future", New Electronics, vol. 17, No. 2, Jan. 1984, London, Great Britain, pp. 49, 51, 53.

*Primary Examiner*—Joseph H. McGlynn
*Attorney, Agent, or Firm*—Perman & Green

[57] ABSTRACT

A low insertion force electrical connector system comprises a receptacle having a plurality of electrical contacts arranged in at least two opposing rows. A low insertion force system selectively spaces apart or closes the electrical contacts to limit insertion of a circuit board with a low force. Devices are provided for aligning and locking the circuit board within the receptacle and an actuating system is arranged to serially operate the aligning and locking devices first followed by the low insertion force system.

24 Claims, 8 Drawing Sheets

LOW INSERTION FORCE CIRCUIT BOARD CONNECTOR ASSEMBLY

This is a continuation of application Ser. No. 554,745 filed on Nov. 23, 1983, now abandoned.

BACKGROUND OF THE INVENTION

The invention herein relates to a circuit board connector system. It is particularly suited for use in computer systems wherein a series of daughter boards are connected to a mother board. The connector system of this invention enables the daughter boards to be inserted into the connector system readily by the computer user.

Reference is hereby made to my copending patent application entitled "Circuit Board Connector Assembly Having Independent Contact Segments," Ser. No. 554,663 filed Nov. 23, 1983, now abandoned.

It is known to make connections between daughter and mother boards by using pin connectors which are soldered to the respective boards. Alternatively, the pins may be electrically interconnected by a wrap-type connection. It is also known in a general sense to make high density connections between the daughter and mother boards.

There are also a number of schemes which are known to provide zero or low insertion force connections. Typical low insertion force connectors are illustrated in U.S. Pat. Nos. 3,553,630 to Scheingold et al; 4,179,177 to Lapraik; 4,047,782 to Yeager; 3,899,234 to Yeager et al; 3,130,351 to Giel; 3,022,481 to Stepoway; and 3,683,317 to Walkup. Similar devices are also disclosed in UK Patent Application Nos. 2,028,015A to Ohtsuki and 2,022,329A to Leather.

In the various prior art patents and patent applications noted above, the connector assemblies include opposing rows of spring-type contacts. The low or zero insertion force mechanisms vary to some degree but generally include some mechanism for deflecting the spring contacts to space them apart to allow easy insertion of a printed wiring board to the connector. Thereafter, the contacts are put into engagement with corresponding pads on the printed wiring board to make the desired electrical connections. In some cases, the spring contacts are normally biased towards engagement with the printed circuit board and the low insertion force mechanism spreads them apart to allow entry of the printed wiring board to the connector. In other approaches, the contact members are normally spaced apart and are deflected by the low insertion force mechanism into engagement with the printed wiring board. It is also known to employ cam and follower arrangements as the low insertion force connector mechanism. The cam member is actuable to move the follower member to deflect or close the spring contacts as desired.

The invention described herein provides a connector system for mounting on a mother circuit board which receives a daughter board in a manner that it is easily inserted or released from the mother board. The daughter board can be readily aligned within an electrical connector receptacle. The system enables the insertion of a daughter board in the connector receptacle in a single orientation. The system has an improved low insertion force electrical connector system having a high density of individual connections and permits easy serviceability by a user.

SUMMARY OF THE INVENTION

In accordance with this invention, a low insertion force electrical connector system is provided comprising an electrical connector receptacle having a plurality of electrical contacts arranged in at least two opposing rows. The low insertion force system selectively spaces apart the electrical contacts in one row from the electrical contacts in an opposing row to allow the insertion of an electrical plug member with a low insertion force or for providing engagement of said contacts in the one and opposing rows with the plug member so that the receptacle contacts make electrical connection with desired contacts of the plug member. The plug member may comprise a portion of an electronic module or a circuit board such as a printed wiring board.

The connector system further includes devices for aligning and locking the electrical plug member after insertion between the respective one and opposing rows of contacts of the receptacle. In accordance with this invention, an actuating arrangement is provided for actuating the low insertion force system and the aligning and locking devices in a multi-phase operation. Prior to insertion of the plug member into the receptacle, the actuating arrangements selectively space apart the rows of electrical contacts after insertion of the plug member between the respective rows of contacts.

The actuating arrangement actuates serially first the aligning and locking devices to align and lock the plug member within the receptacle. Then, the low insertion force system provides for the engagement of the receptacle contacts with the desired contacts of the plug member. The actuating arrangement is also adapted to serially activate the low insertion force system and the aligning and locking device in a reverse fashion to first space apart the receptacle contacts and then unlock the plug member to allow the plug member to be removed from the receptacle with a low force.

The receptacle, in accordance with this invention, is adapted for mounting on a circuit board such as a mother board. The low insertion force system may be of any conventional design, however, preferably, the electrical contacts comprise spring members and a cam and follower arrangement to deflect or undeflect the spring members to provide the respective spacing apart and engagement functions. In one embodiment, the respective rows of contacts comprise alternating high and low contact portions wherein respective high contacts in one row oppose respective low contacts in the other row and vice versa.

The receptacle, in accordance with this invention, is preferably constructed to allow the plug member or printed wiring board to be inserted from the side or from the top. In accordance with another aspect of the invention, a printed wiring board, circuit board or electronic module is provided with a plug portion for insertion in an electrical connector receptacle. The plug portion includes two parallel rows of contact pads arranged thereon with the pads in one row being staggered relative to the pads in the other row. This permits an increased number of connections which can be made to the circuit board for a given size thereof. Preferably, the plug portion of the circuit board further includes aligning and locking holes for accurately aligning the circuit board in an electrical receptacle connector system. In a most preferred embodiment, a locating notch is also provided in one side of the plug portion whereby the circuit board can be inserted in the electrical receptacle in only one orientation.

DETAILED DESCRIPTION OF THE PREFERRED EMBODIMENTS

Figure 1:
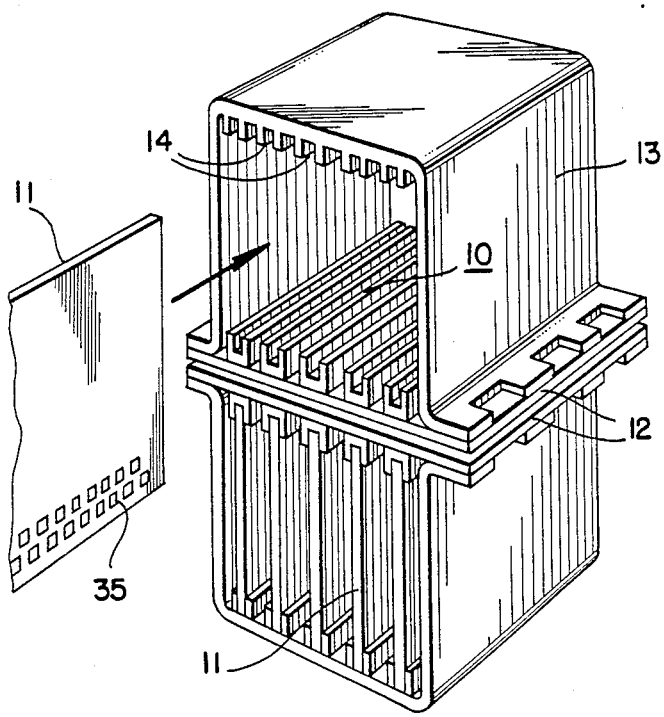
FIG. 1 is a perspective view of a side entry card housing employing a plurality of connector systems in accordance with this invention.
Figure 4:
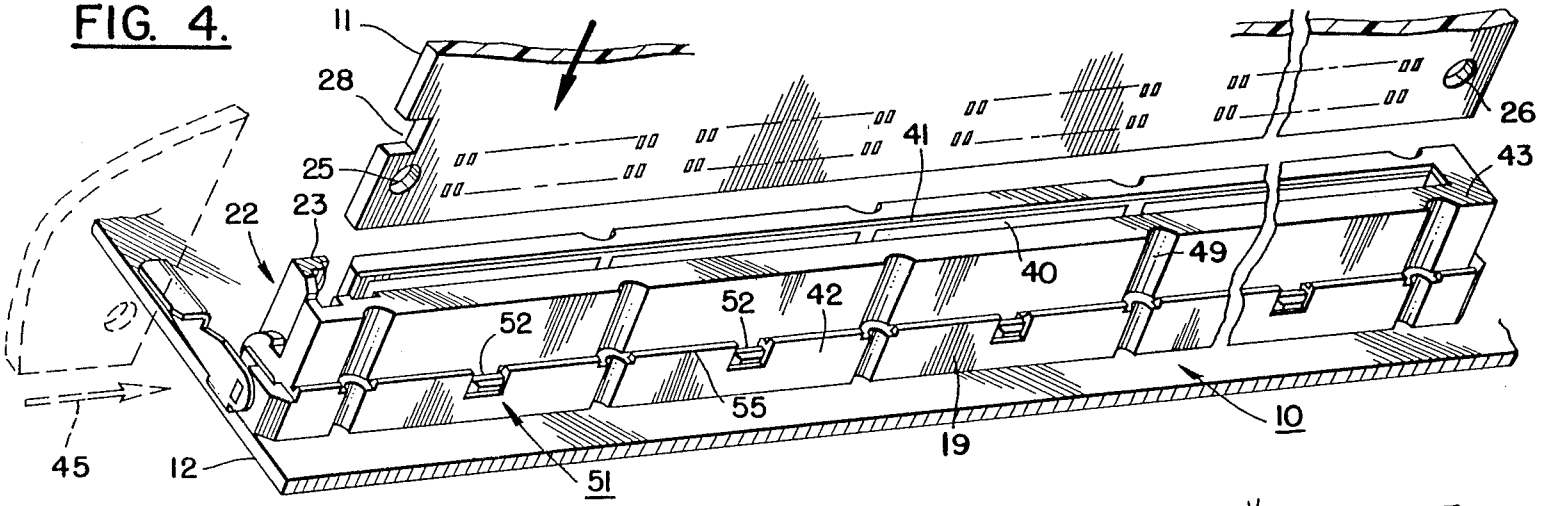
FIG. 4 is a perspective view of a connector system in accordance with this invention mounted to a back plane or mother board with a low insertion force mechanism in its open position for insertion of a module board or daughter board.

Referring now to FIGS. 1 4, the invention will be described in greater detail. The circuit board connector system 10 of this invention is adapted to provide a high density of individual connections which permits increased speed of signals in the system. User serviceability is a particularly important concern in the personal computer field in addition to the maintenance aspect. The circuit board connector system 10 of this invention allows the computer owner to add additional features by buying additional module or daughter boards 11 which can be readily inserted in the circuit board connector systems 10 of this invention. The connector system can be mounted on a mother circuit board or backplane thereby adding increased features to the computer.

The circuit board connector systems 10 of this invention can be arranged on the mother circuit board 12 in one plane. In FIG. 1, card housing 13 and mother circuit board 12 are arranged to receive a daughter circuit board 11 by sliding the daughter board in from the side of the mother board in a direction parallel to the plane of the mother board. The circuit board connector system 10 of this invention acts as the bottom guide for the daughter board 11. The card housing 13 also includes top U-shaped eyes or guides 14 which, with the circuit board connector system 10, serves to provide alignment for the daughter board 11 as it is slid from the side into the card housing 13.

Figure 2:
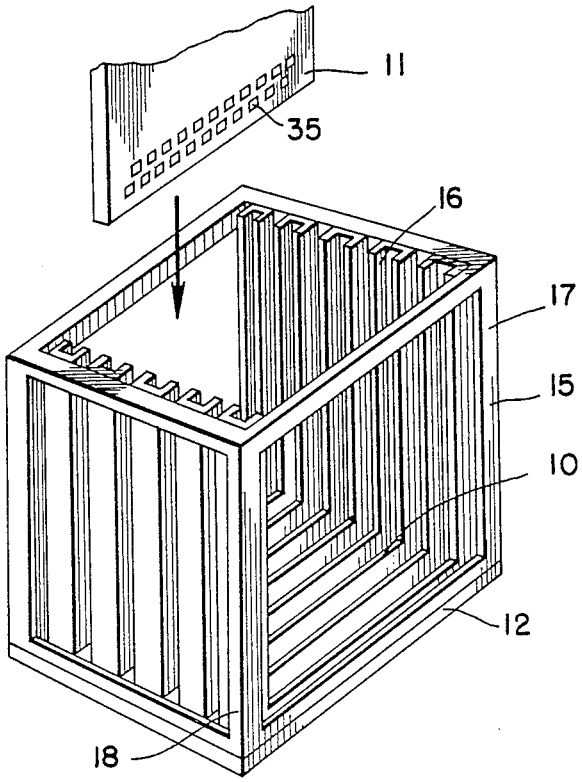
FIG. 2 is a perspective view of a straight-in or top entry card housing employing a plurality of connector systems in accordance with this invention.

It is a feature of the circuit board connector system 10 of this invention that the daughter board can be inserted from the side as in FIG. 1 or from the top as in FIG. 2. In the embodiment of FIG. 2, a card housing 15 includes a plurality of circuit board connector systems 10 arranged in parallel and mounted to the mother circuit board 12. The card housing 15 includes U-shaped side guides 16 arranged in correspondence with the circuit board connector systems 10 along each of the sides 17 and 18 of the card housing 15. In this embodiment the daughter board 11 is inserted into the circuit board connector system 10 by sliding it down the side guides 16 and through the top of the circuit board connector system 10.

The circuit board connector system 10 of this invention requires no soldering to the mother circuit board 12. The connector system 10 includes no pins which can be easily damaged o bent in making connections to the mother circuit board 12. Preferably, the connector system 10 is of the low or zero insertion force type so that the daughter boards 11 are easily removed or inserted as desired.

Figure 3:
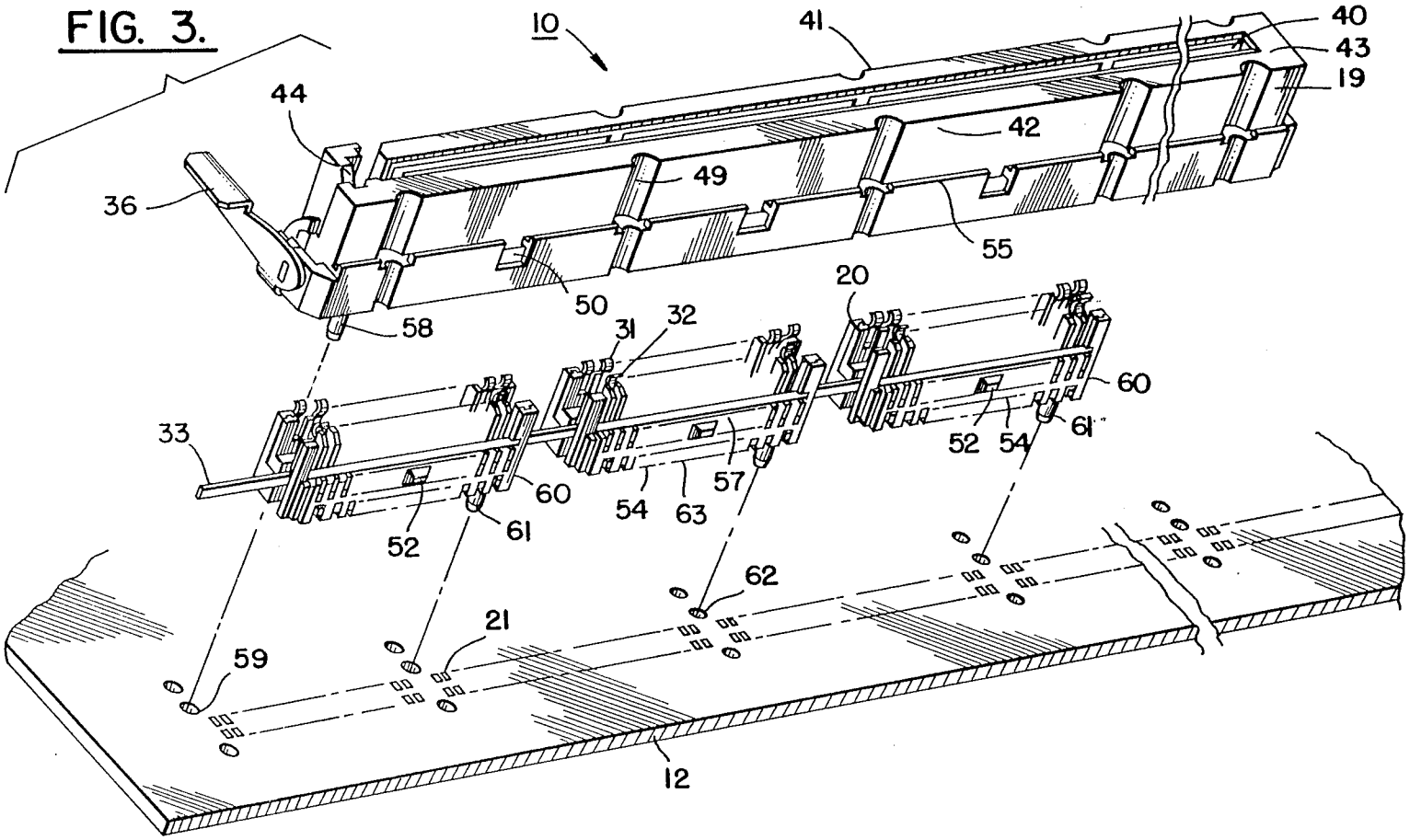
FIG. 3 and 3*a* are exploded perspective views of a connector system in accordance with this invention including a plurality of contact segments.
Figure 3A:
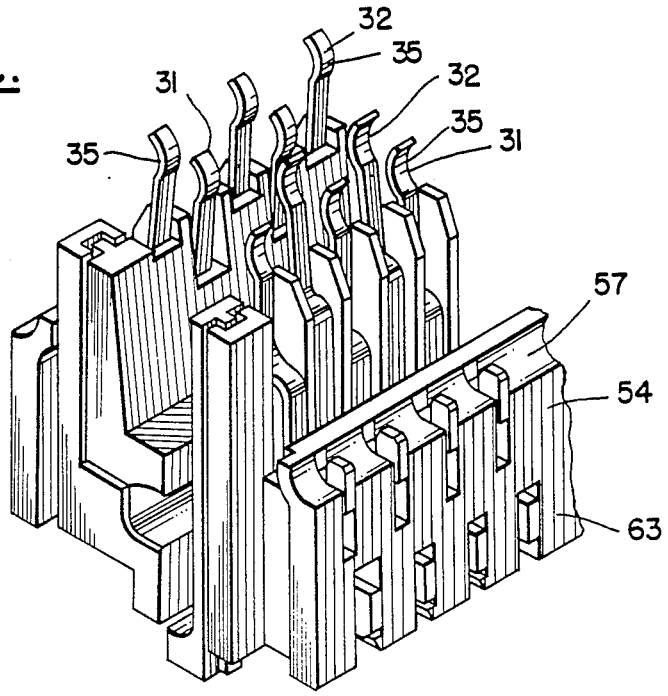
Figure 8:
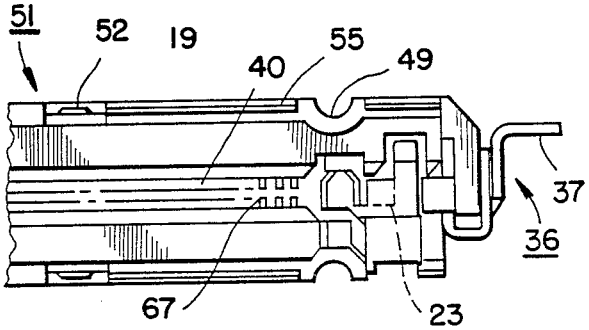
FIG. 8 is a top view of one end of a connector system in accordance with this invention.
Figure 10:
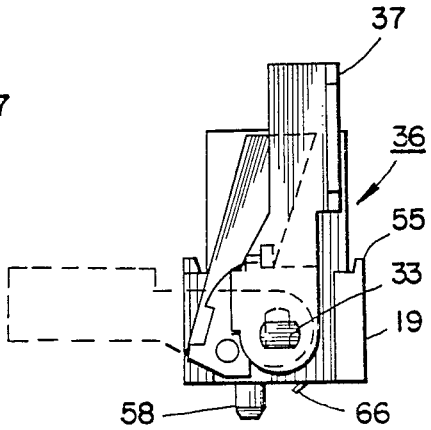
FIG. 10 is an end view of the end portion of the connector system shown in FIG. 8.
Figure 9:
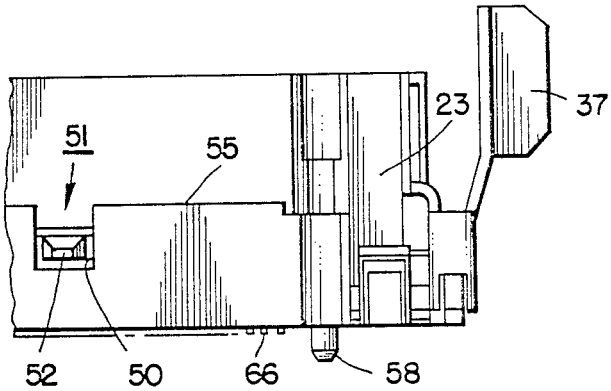
FIG. 9 is a side view of the end of the connector system shown in FIG. 8.
Figure 11:
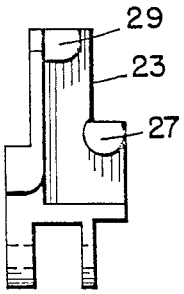
FIG. 11 is a front view of the locking and aligning lever arranged in the end of the connector system shown in FIGS. 8–10.

In accordance with an embodiment of the invention which is best illustrated by reference to FIG. 3, the connector system 10 is comprised of a body shell 19 which is adapted to support, in a floating fashion, a plurality of contact segments 20. Each segment 20 can be customized as to its function in the circuit board connector system 10. For instance, some of the segments 20 can be configured to carry signals, while others can be configured to be power carrying. Thus, different segments 20 can serve totally different functions. Since the segments 20 are supported in a floating arrangement within the body shell 19 they can be independently self-aligned relative to the mother circuit board 12. This can be achieved because the various segments 20 are able to slide within the body shell 19 so that they can be precisely located on the contact pads 21 of the mother circuit board 12. This allows the circuit designer to concentrate on closer tolerances for the contact pads 21 relative to one another on the mother board 12 while allowing looser tolerances within the connector system 10 itself.

In accordance with another aspect of the present invention, a system 22 for aligning and locking the daughter board 11 within the connector system 10 is provided. The system is briefly illustrated by referring to FIGS. 4 and 5. Aligning and locking levers 23 and 24 ar pivotally supported in opposing ends of the body shell 19. The daughter boards 11 include a corresponding pair of alignment holes 25 and 26 in FIG. 4. The connector system 10 is shown in its open position adapted for receipt and insertion of the daughter board 11.

Figure 5:
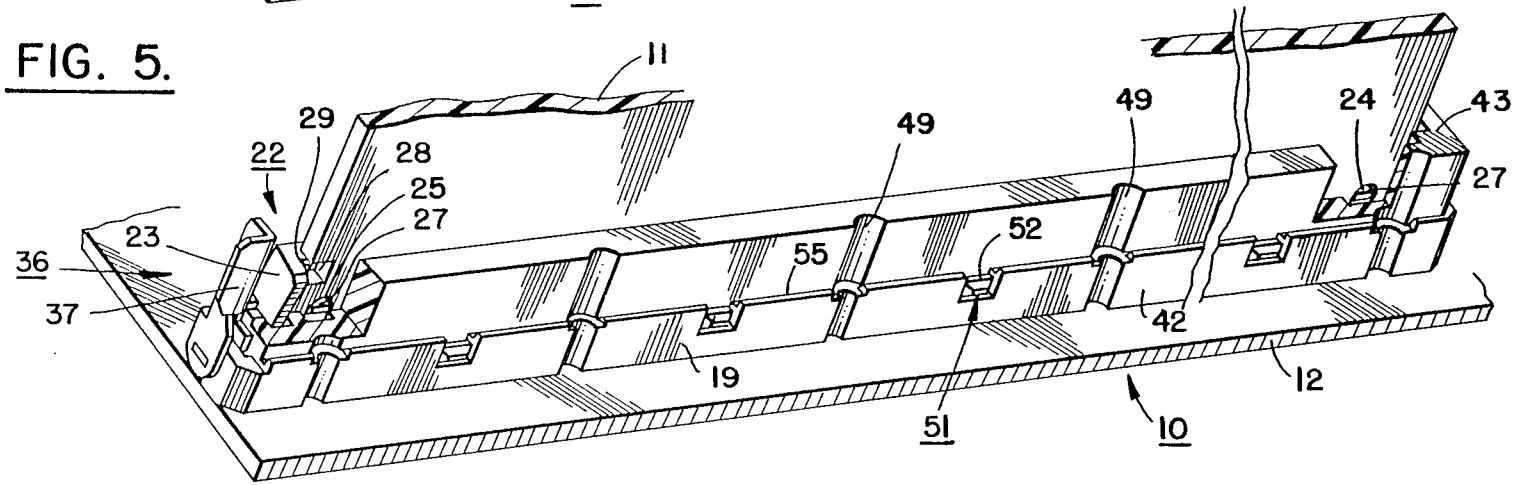
FIG. 5 is a perspective view of the connector system as in FIG. 3 which has been partially cut away to show the locking and alignment feature thereof with respect to a module board inserted therein.

In FIG. 5, the connector system 10 is shown with the daughter board 11 fully inserted and with the aligning and locking system 22 in its closed position. In this position, projections 27 of the respective locking levers 23 and 24 are inserted within the holes 25 and 26 to align and lock the daughter board 11 in a desired relationship relative to the plane of the mother board 12. Projection 27 on locking lever 23 serves to align the daughter board in a lateral sense within the connector system 10. Projection 29 on locking lever 23 obstructs one end of elongated slot 40 when connector 15 is in the closed position, assuring that daughter board 11 cannot be inserted in either the horizontal o the vertical direction until the connector is opened. A notch 28 in the daughter board provides clearance for projection 29 when lever 23 is in the closed position with the daughter board properly in place.

In accordance with yet another aspect of the present invention, the connector system 10 employs a zero or low insertion force system 30 having spring contacts 31 and 32 and a cam 33 and follower 34 arrangement. The cam and follower act upon the spring contacts 31 and 32 to provide, in an open position as shown in the left-hand system 10 (see FIG. 6), a low or zero insertion force for the daughter board into the system. Conversely, when in a closed position, as shown in the right-hand system 10 of FIG. 6, an electrically contacting engagement is made between the spring contacts and respective contact pads 35 on the daughter board 11.

In accordance with yet another aspect of the present invention, the respective spring contacts are arranged in a alternating high and low fashion to allow an increased density of electrical contacts.

In accordance with yet another aspect of the present invention, an actuating system 36, as best illustrated in FIGS. 7–16, is provided which is adapted to serially actuate the respective aligning and locking system 22 and low insertion force system 30. The actuating system 36 includes an actuating lever 37 which includes a pad 38 which is adapted to operate as an actuating cam. It also includes a follower portion 39 on each of the locking levers 22 and 23. Upon pivoting the actuating lever 37, the pad 38 and follower portions 39 cooperate to provide the desired serial actuation of the respective aligning and locking system 22 and low insertion force system 30.

The circuit board connector system 10, and the various aspects of the invention embodied therein, is now described in greater detail to define the preferred embodiments thereof. Referring now to FIGS. 3, 4, 7 and 12, there is shown an electrical connector system which comprises an electrical connector receptacle for attachment to a circuit board 12 such as a mother board or backplane. The receptacle 10 is adapted to receive an electrical plug member 11 which can comprise part of an electronic module or a circuit board such as a daughter board.

Receptacle 10 is comprised of a body shell 19 and contact segments 20 as previously described. The body shell 19 comprises an elongated slot 40 defined by opposing side walls 41 and 42 and end wall 43. Region 44 of the slot opposing the end wall 43 is open. The circuit board 11 can therefore be inserted into the receptacle 10 from the top or from the side in the direction shown by the arrows 45 and 46 (see FIG. 4).

Figure 7:
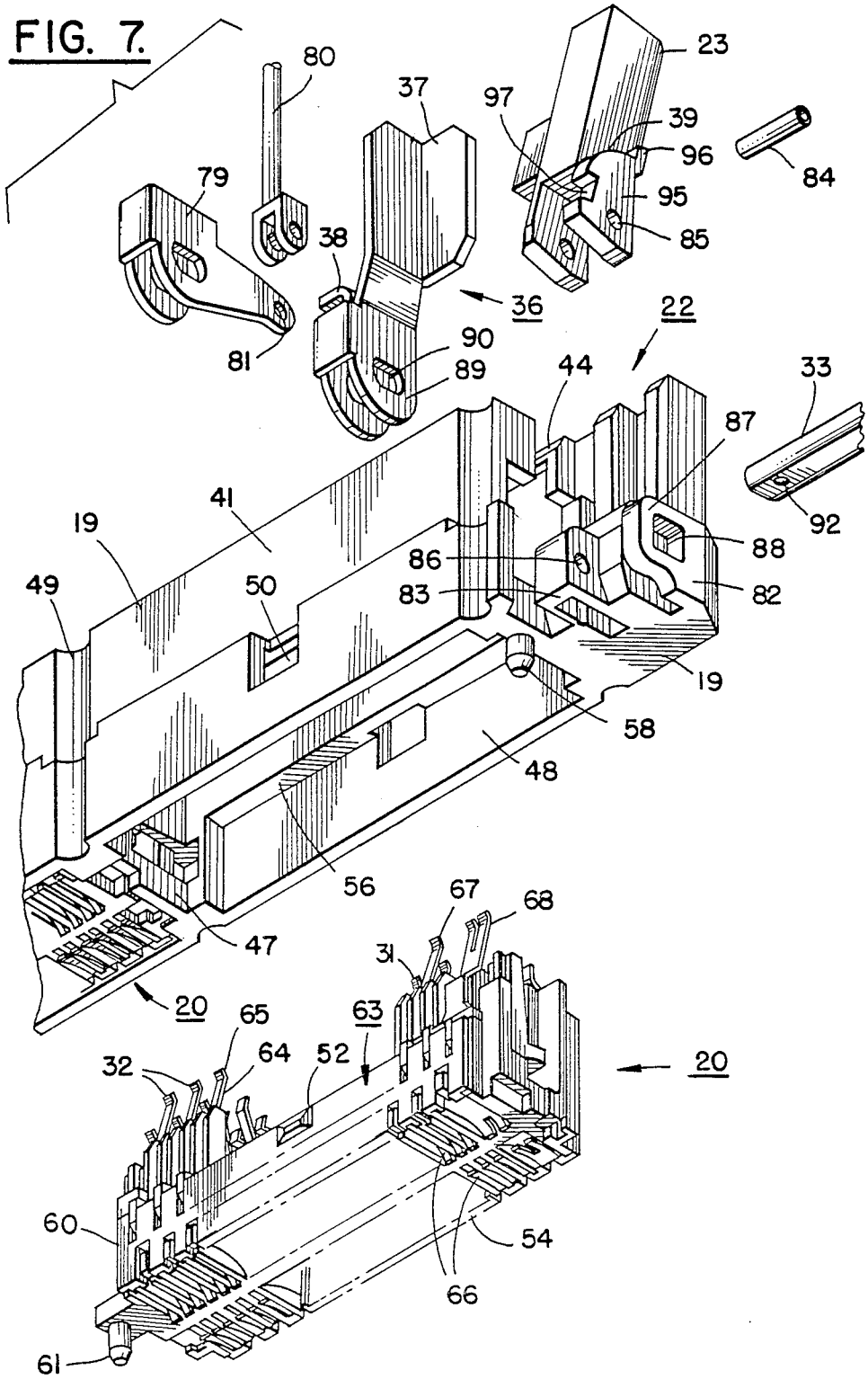
FIG. 7 is an exploded perspective view of a connector system in accordance with this invention illustrating the locking and aligning mechanism.
Figure 12:
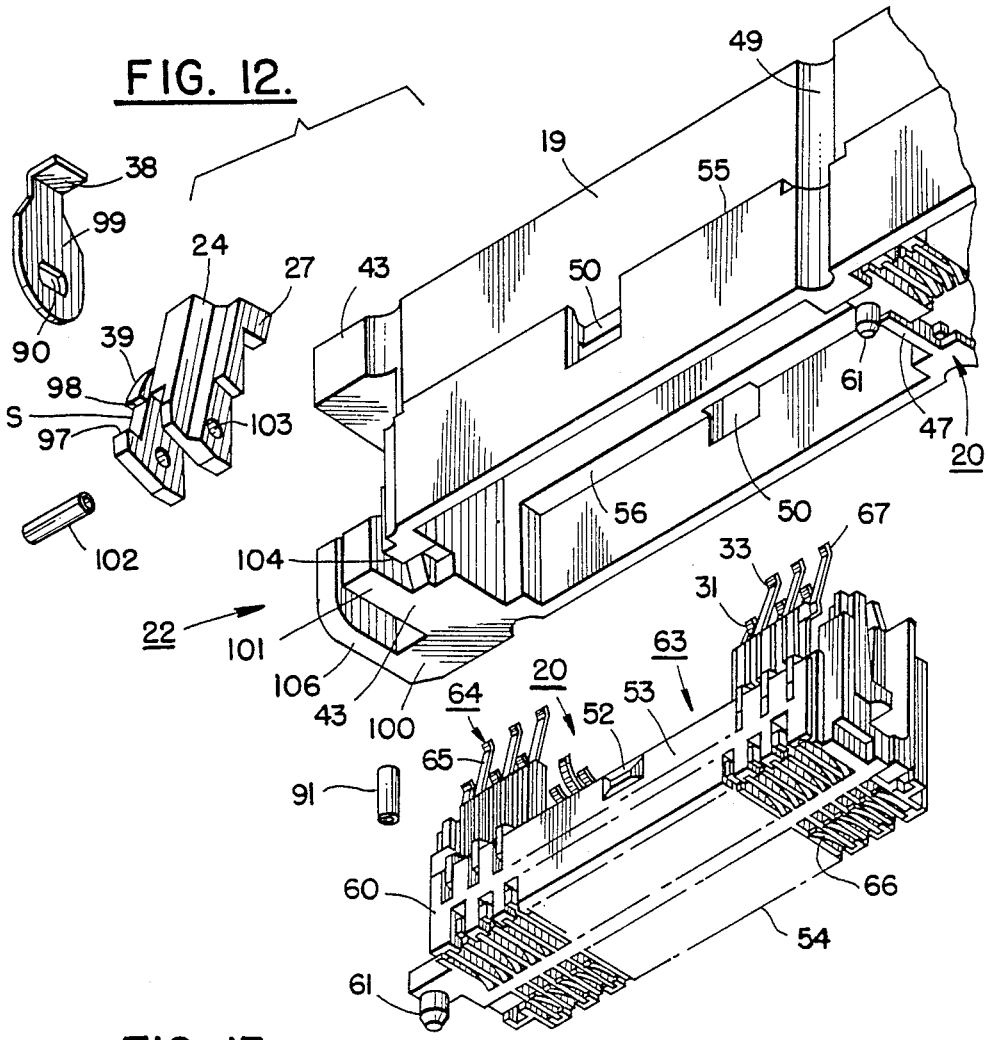
FIG. 12 is an exploded perspective of the opposing end of the connector system in accordance with this invention.
Figure 13:
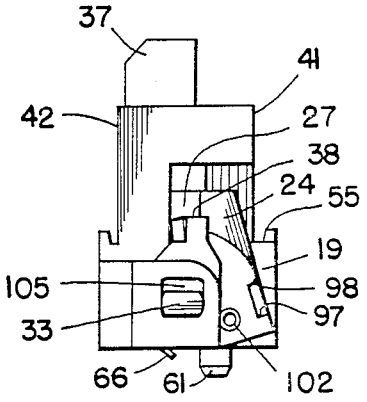
FIG. 13 is an end view of the opposing end of the connector system shown in FIG. 12.
Figure 14:
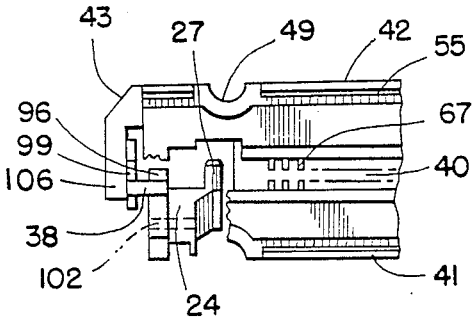
FIG. 14 is a top view partially cut away to reveal the locking and aligning lever in the opposing end of the connector system of FIG. 12.
Figure 15:
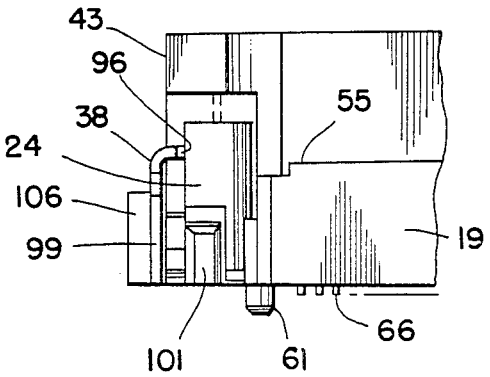
FIG. 15 is a side view of the opposing end of the connector system of FIG. 12.

As shown in FIG. 7 and 12, the segments 20 are inserted into the body shell 19 from the bottom. The body shell 19 includes internal dividing walls 47 which divide the shell into a plurality of chambers 48. The number of chambers 48 corresponds to the number of segments 20 to be supported by the body shell 19. A series of depressions 49 in the side wall 41 and 42 mark the respective locations of the internal walls 47. Generally centrally of each of the side walls 41 and 42 of each respective chamber 48 there is located a rectangular hole 50. This comprises part of a system for supporting the segments 20 within the body shell 19 in an independent floating arrangement so that each segment 20 can be independently aligned to the circuit board 12.

The other elements of the floating support system 51 are a projection 52 correspondingly centrally located on each segment 20 side wall 53 and 54. The projections 52 have a pyramid shape so that when the segments 20 are inserted into the chamber 48, the projections 52 spread apart the respective side walls 41 and 42 until the projections 52 snap into the holes 50. The holes 50 are larger in width and height than the corresponding width and height of the projection 52 thereby allowing the segments to have a limited degree of freedom within the chamber 48 both vertically and from side to side and back to back. A step 55 in each of the side walls 41 and 42 provides a corresponding internal step surface 56 limiting vertical movement of the segment 20 when the receptacle 10 is mounted to the circuit board 12. This provides an effective means for clamping the segments down on the circuit board 12.

Each segment 20 includes a longitudinal ledge 57 in each of the respective side walls 53 and 54 which is adapted to engage the respective stop surfaces 56. The body shell 19 further includes an alignment projection 58 at one end 44 which is adapted to mate with a corresponding alignment hole in the circuit board 12. The segments 20 include at one end an alignment projection 61 adapted to seat in corresponding alignment holes 62 of the circuit board 12 when the segments 20 are inserted in the cavities 48 of the shell 19. The alignment projections 58 and 61 extend in a spaced apart arrangement across the entire receptacle 10 and provide an effective means for aligning the receptacle on the circuit board 12 when the projections seat in the alignment holes 59 and 62. The segments 20 can float particularly from side to side within the body shell 19 to a limited extent since each segment includes its own alignment projection system 61.

Very accurate alignment of each segment is achieved to the circuit board 12 and there is no buildup of any tolerance mismatch over the length of the receptacle 10. This is a highly significant feature since it is desired to pack as many contacts as possible into each segment. It is a unique feature of the present invention that a very high density of electrical contacts can be employed in the receptacle while maintaining adequate alignment with the corresponding contact pads 21 of the circuit board 12.

Each segment 20 is composed of a segment body 63 which is arranged to support two opposing rows of spring contact members 64. One end 65 of each spring contact member comprises a contact portion for engaging a corresponding contact pad 35 of a daughter board 11. The opposing end 66 of the spring contact member 64 comprises a lever-type contact portion for engaging and contacting the contact pads 21 of the mother board 12. The use of lever-type contact 66 and contact pads 21 provides a gas-tight, high pressure connection. The end of the contact portion 66 is forced into the contact pad 21 and, by digging into it, makes a good electrical connection because it breaks through the oxides on the surface of the pad. With this type of contact arrangement, it is not necessary to provide gold contact pads or gold plating of the portion 66 A tin-to tin connection, which is much less expensive, is thereby possible. The contact pads 35 on the daughter board, however, are normally gold plated.

The contact members 64 can be selected to be signal carrying, such as the narrow contact members 32, or they can be power or current carrying such as the relatively wider contact member 68. The segments 20 can therefore have their functions tailored as desired for handling signals or power or any other function which might be required.

It is a preferred feature of the present invention t provide the highest density of contact members 64 in the segment 20. This is partially accomplished by providing alternating high 32 and low 1 contact members in each respective row of contacts. Further, respective high contacts 32 in one row are arranged in opposition to respective low contacts 31 in the opposing row of contact members 64. Correspondingly, a low contact 31 in the one row of contacts is an opposition to a high contact in the opposing row of contacts. These high and low contacts 32 and 31 are adapted to engage two staggered rows of contact pads 35 as illustrated in FIG. 1 by staggering the contact pads 35 in two rows as shown.

It is possible to provide a higher density of contacts with a greater tolerance concerning the alignment of the contact portion 65 o' each segment with the pads 35. This minimizes the risk of a misregistration between the contact portion 65 of the respective high and low contacts 32 and 31 of each segment with the contact pads 35. It also enables a reduced chance of shorting in the event that the contact portions 65 are slightly bent since there is quite a large distance between high contacts in any particular row. This is also true of the low contacts. This scheme permits the size of the pads 35 to be increased and minimizes the criticality of a spacing between the pads.

Figure 6:
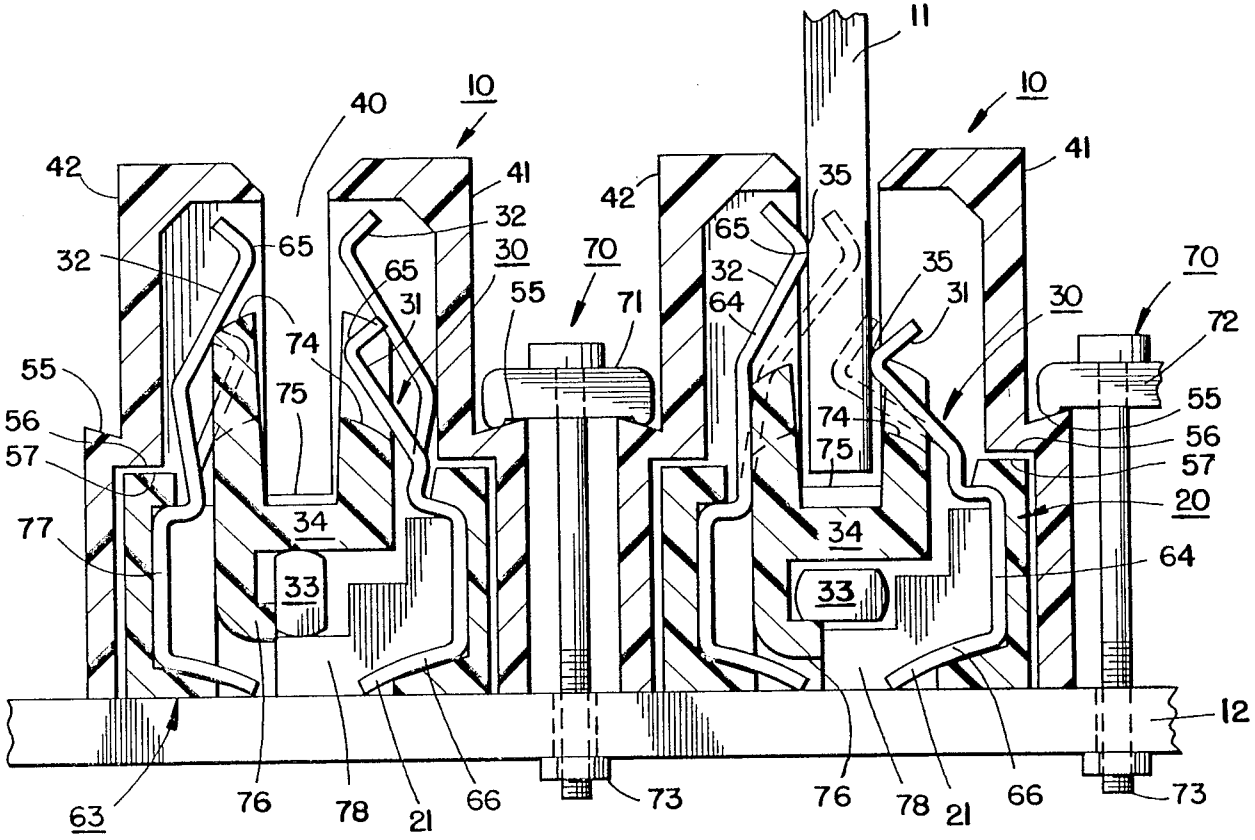
FIG. 6 is an end view and cross section of two adjacent connector systems in accordance with this invention with the low insertion force mechanism in respectively opened and closed positions.

A series of connector systems 10 can be placed on a mother circuit board 12 with any type of conventional hold down or clamping device 70 such as the on illustrated in FIG. 6. The clamping members 71 or 72 are arranged to engage the step 55 in the side walls 41 or 42. The clamping members 71 or 72 are secured to the circuit board or mother board 12 by bolts 73 or otherwise fastened to the circuit board 12 so as to enable the contacts 66 of the spring contact members 64 to engage the pads 35 on the mother board 12. As previously described, the stop surface 56 engages the ledge 57 of the segment 20 to hold the segment 20 so that the contacts 66 make good electrical connection to the contact pads 35. The clamping member 71 is adapted to be employed between adjacent receptacles 10 whereas the clamping member 72 is adapted to clamp a free side 41 of the receptacle 10.

A great deal of flexibility in constructing a computer circuit board system is possible with a design of this electrical connector system. The receptacle 10 can have any multiple of segments 20; for example, 5, 7, 11, etc., as desired. A plurality of receptacles 10 can be arranged on the mother board in adjacent parallel relationship as shown in FIGS. 1 and 6.

If desired, the receptacle can extend beyond the mother board 12 so that additional connector segments 20 in the receptacle 10 can be connected to other types of plug portions and circuit connectors or elements. For example, the receptacle 10 can encompass the mother board as well as accommodate other totally different types of connections located completely off the mother board.

Each of the segments 20 includes a low or zero insertion force mechanism for system 30. The contact members 64 in the embodiment shown in FIG. 6 are biased towards the contact members of the opposing row so that if they were in their free state, they would take the positions shown in phantom in the right-hand receptacle 10 of FIG. 6. The low insertion force mechanism thereby employs a cam 33 and follower 34.

When the cam 33 is rotated to a position shown in the left-hand receptacle 10 of FIG. 6, follower 34 moves upwardly to deflect the spring member 64 in one row away from the spring members 64 in the opposing row. This allows the circuit board 11 to be inserted in the slot 40 with a low or zero insertion force. When the cam 33 is rotated to the positions shown in the right-hand receptacle 10 of FIG. 6, the follower 34 is lowered to release the contact member 64 so that the contact portion 65 engage the respective contact pads 35 of the daughter board 11. Preferably, each segment includes its own separate follower member 34. However, the cam member 33 preferably comprises a unitary member or metal rod extending through all the segments 20 in the receptacle 10. The cam member 33 preferably has an oblong or oval cross-section.

The top surface 74 of the follower member is arranged to engage the spring contact 64 to deflect them to space them apart or release them so that they can engage the daughter board 11. The follower member 34 has a U-shaped cross-section for its upper portion. When it is positioned as in the left-hand receptacle 10 in FIG. 6 for receipt of the circuit board 11, the U-shaped bottom 75 serves as a stop surface for aligning the circuit board 11 during insertion. The lower portion of the follower member 34, cross-section 76, has a hook-like shape so that when the follower member is withdrawn as in the right-hand receptacle 10 in FIG. 6, it is held down in the withdrawn position by engagement between the cam 33 and the hook-portion 76.

The segment body 63 includes an outer segment support member 77 and an inner segment support segmet 78. The spring contacts 64 are held in place between the respective support members 77 and 78. The inner support member 78 also serves to support the cam and follower members 33 and 34.

While the low or zero insertion force mechanism 30 has been described by reference to the embodiment particularly shown in FIG. 6 any desired low insertion force mechanism can be employed as illustrated by the numerous patents noted in the background of this application. While it is preferred, in accordance with this invention, for the spring contact members 64 in one row to be biased towards the spring contact members 64 in the opposing row if desired, as illustrated in the background of this invention, the opposite approach can be employed. In such an opposite approach, the follower member serves to deflect the spring contacts 64 to have the contact portions 65 engage the contact pads 35 or release the spring contacts so that they are spaced apart in their free state.

As illustrated in FIG. 7, actuating lever 37 is secured to the cam 33. This enables the operator to rotate the cam 33 by moving the lever 38 between its respective open and closed positions illustrated in FIGS. 4 and 5. Alternatively, if desired, the length of the lever 37 can be made much longer so that an operator need only reach to the top of the circuit board area in order to turn it. This embodiment also provides greater leverage on the cam 33 for easier operation. Yet another approach adapted for remote actuation is to substitute a lever 79, which by the use of a suitable linkage 80 pivotally connected to the end 81 of the lever 79, can be remotely actuated. For example, the linkage 80 can be brought out through a hole, not shown, in the top of the card housing 13 shown in FIG. 1. By pulling up on the linkage 80, the cam 33 is pivoted to open the receptacle for insertion of the circuit board 11. By pushing down on the linkage 80, the reverse of the operation takes place.

Referring now to FIGS. 4–5 and 7–16, the aligning and locking system 22 and the actuating system 36 will be described in greater detail. As previously described, the aligning and locking system 22 is comprised of locking levers 23 and 24. The body shell 19 includes a support extension 82 at its end 44. The lever 23 is pivotally supported about an extension base 83 by means of a split cylinder pin 84 inserted through holes 85 and 86 in the respective lever 23 and base 83.

Figure 16:
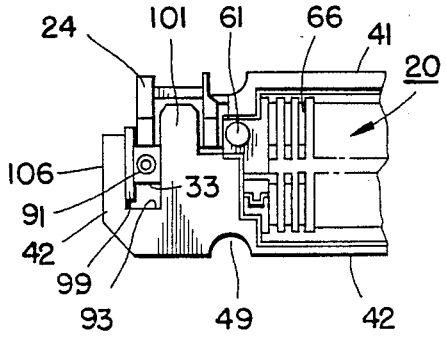
FIG. 16 is a bottom view of the opposing end of the connector system as in FIG. 12.

A second extension support base 87 includes a squarish hole 88 through which the cam 33 is inserted. Prior to insertion of the cam 33, the actuating lever 37, fork-like projections 89, is positioned with a base 87 between the legs of the fork-like projections 89. A slot 90 in the fork-like projections 89 closely fits the cross-section of the cam 33. The cam 33 is held within the receptacle 10 after insertion by means of a split pin 91 inserted through a hole 92 in the cam 33 within a slot 93 formed in each of the respective segments 20. This construction is best illustrated in FIG. 16. The pin 91 serves to lock the cam in place and the cam, in turn, serves to lock the actuating lever 37 in place.

Referring now more particularly to the actuating and locking systems 22 and 36 at the end 44 of the body shell 19, reference is had to FIGS. 7–11. The locking lever 23 includes a first projection 27 which is adapted to be inserted in an alignment hole 25 on one side of the circuit board 11. It further includes a second projection 29 which is adapted to be inserted in the notch 28 on one side of the circuit board 11. The locking lever 23 also includes a follower portion 39 defined by the upper surface of one of the support legs 95. The follower portion 39 includes a notch 97. The actuating lever 37 includes a tab 38 which acts as a cam. The follower portion 39 also includes a stop portion 96 in operation when the lever 37 is in its vertical position as shown. The cam 33 disengages the segment follower 34 so that the contacts 31 and 32 close against the daughter boards. In this position, the tab or cam 38 has engaged the stop portion 96 to pivot the lever 23 against the circuit board 11 so that the projections 27 and 29 seat in the respective hole 25 and slot 28.

When the lever 37 is pivoted in the opposite direction to position as shown in FIG. 4, the cam tab 38 does not pivot the lever 23 until it engages the stop portion defined by the lower side of the slot 97. Therefore, as the lever 37 moves from the stop portion 96 to the stop portion 97, there is no movement of the lever 23. However, the cam 33 is rotated from its closed actuation position to its open actuation position. The tab 38 engages the stop portion 97 before the lever 37 is rotated to its completely open position. After the tab 38 engages the stop portion 97, continued pivoting in a downwardly direction of the lever 37 causes the lever 23 to pivot away from the circuit board, thereby disengaging the projections 27 and 29 from the respective hole 25 and slot 28. Therefore, when the lever 37 is moved from its closed position to its open position, the contacts are first spaced apart under the action of the cam 33 and follower 34 and then the locking lever is disengaged in a serial fashion.

When the lever 37 is moved from its open position as in FIG. 4 to its closed position as in FIG. 5., a reverse series of operations occurs. When the lever 37 is in its full open position, the tab 38, due to the pivoting action of the lever 23, moves into the slot 96. Therefore, the upper side wall of the slot 98 is engaged by the tab 38 of the lever 37 as it begins its movement in an upwardly direction. This causes the lever 23 to pivot about pin 84 into its locking and aligned position against the circuit board 11 with a small rotation of the lever 37. This small rotation however is insufficient to rotate the cam 33 sufficiently against the follower 34 to close the contacts. As the lever 23 pivots under the action of the pad 38 against the stop portion 98 (see FIG. 12), the tab moves out of the slot 97 just as the lever 23 fully aligns and locks against the board 11. The lever 37 is thereafter free to continue rotation to its upward position against the stop 96 and thereby release the contacts for engagement with the circuit board. Therefore, the action of the cam 38 and follower 39 is such that when the lever 37 is moved from its open position to the closed position, shown in FIGS. 4 and 5, respectively the circuit board is first aligned and locked in place and then the contacts are released to engage the circuit board.

In accordance with a preferred embodiment of this invention, the aligning and locking system 22 and actuating systems 36 include the second aligning and locking lever 24 and a second actuating lever 99. The second lever 24 and the second lever 99 are located at the opposing end 43 of the body shell 19. By means of a support extension 100, the extension 100 includes a support 101 about which the lever 24 is pivotally supported by a split pin 102. It extends through holes 103 in the lever 24 and 104 in the base 101. As previously described, the cam rod 33 extends through a slot 93 terminating in a squarish hole 105 in a second support base 106 in the extension 100.

The second actuating lever 99 includes a slot 90 which has a cross-section closely corresponding to the cross-section of the cam 33. The lever 99 is positioned about the cam 33 between the lever 24 and the support base extension 106. The lever 99 includes tab 38 corresponding to the tab of the lever 37. Similarly, the lever 24 includes a follower portion 39 corresponding to the follower portion of the lever 23. The follower portions include a slot S including stop portions 97 and 98.

The operation of lever 99 is tied to the operation of lever 37 by the cam 33. The inner action of lever 99 with the lever 24 via the tab 38 and follower 39 is identical to the inner action previously described with the respect to the levers 37 and 23 and, therefore, is not described again. When the lever 37 is moved between its respective open and closed positions, the lever 99 moves between corresponding positions and interacts with the lever 24 in the same manner as the lever 37 interacts with the lever 23.

The projections 27 which serve to align and lock the circuit board 11 in the receptacle 10 are tapered so that a slight misalignment of the circuit board 11 does not prevent alignment and locking of the board into the receptacle. The taper of the projections 27 serve to move the board into its properly aligned position. It should be apparent that the contacts 67 of the receptacle 10 cannot be closed unless the circuit board 11 is properly locked and aligned within the receptacle. Any misalignment would prevent the projections 27 and 29 from being inserted in the respective alignment holes 25 and slot 28. This, in turn, would prevent the pivoting of the levers 23 and 24 into their fully and aligned positions. The failure of those levers to pivot to their fully aligned and locked positions results in the tab 38 of the levers 37 and 99 engaging the stop portion 96 on the respective followers 39. This prevents further pivoting of the lever 37 and the cam 33, thereby preventing engagement of the contact to the circuit board 11.

Further it is necessary that the projections or alignment pins 27 and 29 on both sides of the receptacle 10 be seated in their respective holes 25 and slot 28 in order to completely close the contacts 67 of the receptacle 10. Thus, the receptacle lever 37 cannot be fully closed to the position shown in FIG. 5 unless both corners of the circuit board 11 are fully seated in the connector housing. In the event of a misalignment, the operator cannot close the handle 37 completely and must readjust the circuit board 11 so that the alignment can take place. When the lever 37 is in the position of FIG. 5, the circuit board cannot be pulled out of the receptacle 10 unless the handle 37 is first pivoted to its open position as shown in FIG. 4.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. In a low insertion force electrical connector system comprising an electrical connector receptacle having a plurality of electrical contacts arranged in at least two opposing rows and a low insertion force means selectively spacing apart the electrical contacts in one row from the electrical contacts in an opposing row to allow the insertion of an electrical plug member with a low insertion force and also providing engagement of said contacts in said one and said opposing rows with said plug member so that said receptacle contacts make electrical connection with desired contacts of said plug member; the improvement wherein, said electrical connector system further comprises:

(a) means for aligning and locking said electrical plug member by positive engagement therewith within defined limits after insertion between one and opposing rows of contacts of said electrical connector receptacle; and means for actuating said low insertion force means and said aligning and locking means in a multiphase operation wherein, prior to insertion of said plug member into said receptacle, said actuating means is initially moveable to actuate said low insertion force means to selectively space apart said rows of electrical contacts and wherein after insertion of said plug member between said rows of contacts of said receptacle said actuating means is initially moveable to actuate serially first said aligning and locking means to align and lock said plug member within said receptacle and then said low insertion force means to provide engagement of said receptacle contacts with said desired contacts of said plug member.

2. A system as in claim 1 wherein said actuating means is adapted to serially actuate said low insertion force means and aligning and locking means in a reverse fashion to first space apart said receptacle contacts and to then unlock said plug member to allow said plug member to be removed from said receptacle with a low force.

3. A system as in claim 2 wherein said plug member comprises a portion of at least one of an electronic module and a first circuit board.

4. A system as in claim 3 wherein said receptacle is mounted on a second circuit board and electrically connected therewith.

5. A system as in claim 4 wherein each of said one and opposing rows of receptacle contacts comprises alternating high and low contacts.

6. A system as in claim 5 wherein respective high contacts in said one row oppose respective low contacts in said opposing row and wherein respective low contacts in said one row oppose respective high contacts in said opposing row.

7. A system as in claim 6 wherein said receptacle contacts comprise first portions of respective spring members wherein said low insertion force means comprises cam means and follower means for deflecting or undeflecting spring members to provide said spacing apart or said engagement of said receptacle contacts.

8. A system as in claim 7 wherein said aligning and locking means comprises at least one first lever means pivotally supported by said receptacle, said lever means including at its free end at least one first projection which is adapted to be pivotally inserted into a corresponding alignment hole in said plug member.

9. A system as in claim 8 wherein said aligning and locking means includes at least two of said first lever means respectively arranged at opposing ends of said receptacle.

10. In a low insertion force electrical connector system comprising an electrical connector receptacle mounted on a second circuit board and electrically connected therewith and having a plurality of electrical contacts arranged in at least two opposing rows and a low insertion force means selectively spacing apart the electrical contacts in one row from the electrical contacts in an opposing row to allow the insertion of an electrical plug member with a low insertion force and also providing engagement of said contacts in said one and said opposing rows with said plug member so that said receptacle contacts make electrical connection with desired contacts of said plug member, said plug member comprising a portion of at least one of an electronic module and a first circuit board; the improvement wherein each of said one and opposing rows of receptacle contacts comprises alternating high and low contacts, said respective high contacts in said one row opposing said respective low contacts in said opposing row and said respective low contacts in said one row opposing said respective high contacts in said opposing row, said receptacle contacts also comprising first portions of respective spring members and wherein said low insertion force means comprises cam means and follower means for deflecting or undeflecting said spring members to provide said spacing apart or said engagement of said receptacle contacts and wherein said electrical connector system further comprises:

(a) means for aligning and locking said electrical plug member by positive engagement therewith within defined limits after insertion between one and opposing rows of contacts of said electrical connector receptacle, said aligning and locking means comprising at least two first lever means pivotally supported by said receptacle, said first lever means respectively arranged at opposing ends of said receptacle, each of said first lever means including at its free end at least one first projection which is adapted to be pivotally inserted into a corresponding alignment hole in said plug member; and (b) means for actuating said low insertion force means and said aligning and locking means in a multiphase operation wherein, prior to insertion of said plug member into said receptacle, said actuating means is adapted to actuate said low insertion force means to selectively space apart said rows of electrical contacts and wherein after insertion of said plug member between said rows of contacts of said receptacle said actuating means is adapted to actuate serially first said aligning and locking means to align and lock said plug member within said receptacle and then said low insertion force means to provide engagement of said receptacle contacts with said desired contacts of said plug member, and wherein said actuating means is adapted to serially actuate said low insertion force means and aligning and locking means in a reverse fashion to first space apart said receptacle contacts and to then unlock said plug member to allow said plug member to be removed from said receptacle with a low force, said actuating means comprising two second lever means respectively secured to said cam means at opposing ends thereof and of said receptacle and said second lever means including a tab portion for engaging said first lever means to pivot said first lever means between respective locking and unlocking positions.

11. A system as in claim 1 wherein said tab portion comprises a cam and wherein said first lever means includes a follower portion contoured to provide said respective serial actuations.

12. A system as in claim 11 wherein said receptacle is configured so that said plug member can be inserted therein either longitudinally or transversely of a direction in which said one and opposing rows of receptacle contacts extend.

13. A system as in claim 12 wherein said first projection of said first lever means is adapted to align said plug member transversely of said direction in which said one and opposing rows of said receptacle contacts extend and further including means for obstructing the insertion of said plug member into said connector system when said means for actuating said low insertion force means is actuated.

14. A system as in claim 13 wherein said means for obstructing the insertion of said plug member is a second projection of said first lever means and wherein said receptacle includes a first end wall and a base wall limiting the depth to which said plug member can be inserted in said receptacle, said base wall comprising part of said follower means and wherein said second projection defines a second end wall of said receptacle.

15. A system as in claim 14 wherein said spring members are arranged to bias said receptacle contacts into engagement with said plug member and wherein said low force insertion means is adapted to deflect said spring members to space apart said respective rows of receptacle contacts.

16. A system as in claim 14 including a plurality of receptacles mounted in a parallel spaced relationship to said second circuit board with each of said receptacles having respectively associated therewith said low insertion force means, said aligning and locking means and said actuating means.

17. A system as in claim 14 wherein each of said spring members includes a second contact portion at an end thereof opposed to said first contact portion, said second contact portions being arranged in two opposing rows in said receptacle and being biased outwardly from the bottom thereof, said second contact portions being adapted to engage corresponding desired contacts of said second circuit board.

18. A system as in claim 14 wherein said receptacle includes a body shell member and a plurality of contact segments with each said segment including said one and opposing rows of receptacle contacts and wherein said segments are supported in a floating manner within said shell member, each of said segments including an alignment projection for insertion in a respective alignment hole in said second circuit board.

19. A system according to claim 18 wherein said follower means comprises a separate follower member supported by each said segment and wherein said cam means comprises a unitary member extending through all of said segments.

20. A system as in claim 19 including a plurality of receptacles mounted in a parallel spaced apart fashion to said second circuit board with each of said receptacles having respectively associated therewith said low insertion force means, said aligning and locking means and said actuating means.

21. A system as in claim 20 wherein each of said spring members includes a second contact portion at an end thereof opposed to said first contact portion, said second contact portion being arranged in two opposing rows in said receptacle and being biased outwardly from the bottom thereof, said second contact portions being adapted to engage corresponding desired contacts of said second circuit board.

22. A system as in claim 21 wherein said spring members are arranged to bias said respective contacts into engagement with said plug member and wherein said low force insertion means is adapted to deflect said spring members to space apart said respective rows of receptacle contact.

23. A system as in claim 22 further including means for operating said actuating means remotely of said second circuit board.

24. A circuit board assembly including:

(a) a plug portion for insertion in an electrical connector receptacle;

(b) two parallel rows of contact pads arranged on said plug portion with the pads in one of said rows being staggered relative to the pads in the other of said rows, whereby an increased number of connections can be made to said circuit board for a given size thereof;

said plug portion having two alignment and locking holes, one of said holes being located adjacent one side of said plug portion and one end of said rows of said contact pads and the other of said holes being located adjacent an opposing side of said plug portion and the opposing end of said rows of said contact pads;

said plug portion additionally having a notch in one side thereof; and actuating means on the receptacle including a projection movable between a distant unactuated position and an actuated position extending into said notch preventing removal of said plug portion from the electrical receptacle.

* * * * *